US010513969B2

(12) United States Patent
Jang et al.

(10) Patent No.: US 10,513,969 B2
(45) Date of Patent: Dec. 24, 2019

(54) ENGINE COOLING SYSTEM

(71) Applicants: HYUNDAI MOTOR COMPANY, Seoul (KR); KIA MOTORS CORPORATION, Seoul (KR)

(72) Inventors: Sung Kweon Jang, Seongnam-si (KR); Yongwoo Kim, Seongnam-si (KR); Youngbae Yang, Hwaseong-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 2 days.

(21) Appl. No.: 15/798,947

(22) Filed: Oct. 31, 2017

(65) Prior Publication Data

US 2018/0163608 A1 Jun. 14, 2018

(30) Foreign Application Priority Data

Dec. 13, 2016 (KR) ..... 10-2016-0169988

(51) Int. Cl.

| | |
|---|---|
| ***F01P 7/14*** | (2006.01) |
| ***F01P 7/16*** | (2006.01) |
| ***F02M 26/32*** | (2016.01) |
| ***F01P 3/02*** | (2006.01) |
| ***F01P 5/10*** | (2006.01) |

(52) U.S. Cl.

CPC ..... *F01P 7/16* (2013.01); *F01P 3/02* (2013.01); *F01P 5/10* (2013.01); *F02M 26/32* (2016.02); *F01P 2003/024* (2013.01); *F01P 2007/146* (2013.01)

(58) Field of Classification Search

CPC ..... F01P 3/02; F02M 26/30; F02M 26/09
USPC ..... 123/41.08
See application file for complete search history.

(56) References Cited

U.S. PATENT DOCUMENTS

| | | | | |
|---|---|---|---|---|
| 4,726,324 | A * | 2/1988 | Itakura | F01P 7/16 123/41.1 |
| 6,360,702 | B1 * | 3/2002 | Osada | F28D 7/0066 123/196 AB |
| 7,721,683 | B2 * | 5/2010 | Lutz | F01P 3/02 123/41.1 |
| 9,470,138 | B2 * | 10/2016 | Miyagawa | F01P 7/16 |
| 2003/0175133 | A1 * | 9/2003 | Koga | F04D 29/049 417/362 |
| 2006/0005791 | A1 * | 1/2006 | Obidi | F01P 3/02 123/41.29 |
| 2008/0168956 | A1 * | 7/2008 | Lutz | F01P 3/02 123/41.1 |
| 2012/0199084 | A1 * | 8/2012 | Kinomura | F01P 7/165 123/41.08 |
| 2013/0160723 | A1 * | 6/2013 | Miyagawa | F01P 7/16 123/41.1 |

(Continued)

*Primary Examiner* — Long T Tran
*Assistant Examiner* — James J Kim
(74) *Attorney, Agent, or Firm* — Brinks Gilson & Lione

(57) ABSTRACT

An engine cooling system may include: a head water jacket that is formed within a cylinder head; a block water jacket that is formed within a cylinder block; an EGR cooler water jacket which cools EGR gas of an exhaust gas recirculation (EGR) device; a water chamber that is formed within the cylinder block, and that supplies a coolant to the head water jacket and the EGR cooler water jacket; and a water pump pumping the coolant to the block water jacket and the water chamber based on the driving state of an engine.

19 Claims, 5 Drawing Sheets

(56) References Cited

U.S. PATENT DOCUMENTS

| | | | | |
|---|---|---|---|---|
| 2015/0167594 | A1* | 6/2015 | Jun | F02M 26/20<br>60/605.2 |
| 2016/0123218 | A1* | 5/2016 | Lee | F01P 7/165<br>123/41.08 |
| 2016/0201549 | A1* | 7/2016 | Kim | F01P 7/165<br>123/41.1 |

* cited by examiner

FIG. 3 "PRIOR ART"

ENGINE COOLING SYSTEM

CROSS-REFERENCE TO RELATED APPLICATION

This application claims priority to and the benefit of Korean Patent Application No. 10-2016-0169988, filed on Dec. 13, 2016, which is incorporated herein by reference in its entirety.

FIELD

The present disclosure relates to an engine cooling system.

BACKGROUND

The statements in this section merely provide background information related to the present disclosure and may not constitute prior art.

Generally, some of heat generated at a combustion chamber of an engine is absorbed by a cylinder head, a cylinder block, intake and exhaust valves, and a piston, etc.

When temperatures of the constituent components of the engine excessively increase, the constituent components may be thermally deformed, or an oil film of an inner wall of a cylinder may be damaged such that lubrication performance deteriorates, resulting in thermal problems of the engine.

Due to the thermal problems of the engine, abnormal combustion such as combustion failure, knocking, etc. occurs, thus a piston may be melted, which may result in serious damage to the engine. Further, thermal efficiency and power of the engine may deteriorate. In contrast, excessive cooling of the engine may cause the power and fuel consumption to deteriorate, and may cause low temperature abrasion of the cylinder, thus it is desired to appropriately control temperature of the coolant.

In this respect, in a typical engine, a water jacket is provided inside a cylinder block and a cylinder head, and a coolant circulating in the water jacket cools a periphery of a combustion chamber and metal surfaces such as peripheries of an exhaust port, a valve seat, etc.

The water pump is connected with auxiliary components of the engine through the belt, and is continuously driven with the starting of the engine to circulate the coolant to the cylinder block and an exhaust gas recirculation (EGR) cooler regardless of warm up condition or cooling condition of the engine.

In addition, the engine according to the related art stops the flow of the coolant passing through the cylinder block to improve the warm-up speed of the engine.

However, the flow of the coolant passing through the cylinder block is only stopped, but the coolant passing through the cylinder head is continuously circulated.

That is, the fuel efficiency and the exhaust gas are stabilized when the engine is warmed up, but since the coolant continuously circulated to the water jacket formed in the cylinder head in a condition that the engine is cold, the warming period of the engine becomes longer, and fuel efficiency is low and the exhaust gas quality is deteriorated.

The above information disclosed in this Background section is only for enhancement of understanding of the background of the present disclosure and therefore it may contain information that does not form the prior art that is already known to a person of ordinary skill in the art.

SUMMARY

The present disclosure provides an engine cooling system that continuously circulates the coolant of the EGR cooler and stops the flow of the coolant flowing to the cylinder head and the cylinder block.

In one exemplary form of the present disclosure, an engine cooling system may include: a head water jacket that is formed within a cylinder head; a block water jacket that is formed within a cylinder block; an exhaust gas recirculation (EGR) cooler water jacket configured to cool EGR gas of an exhaust gas recirculation (EGR) device; a water chamber formed within the cylinder block, and configured to supply a coolant to the head water jacket and the EGR cooler water jacket; and a water pump configured to pump the coolant to the block water jacket and the water chamber based on the driving state of an engine.

The EGR cooler water jacket and the water chamber may be integrally formed with the cylinder block.

The system may further includes a coolant control valve configured to adjust flow of a coolant exhausted from the head water jacket and a coolant exhausted from the block water jacket.

The system may further includes a controller that controls operations of the water pump and the coolant control valve. In particular, the controller may continuously circulate the coolant flowing from the water chamber to the EGR cooler water jacket by controlling operation of the water pump.

Before the engine is warmed up, the controller may close the coolant control valve and stop the flow of the coolant exhausted from the head water jacket and the coolant exhausted from the block water jacket.

The controller may open the coolant control valve after the engine is warmed up, and allow the flow of the coolant exhausted from the head water jacket and the coolant exhausted from the block water jacket.

The coolant flowing into the water chamber may flow along the longitudinal direction of the cylinder block and pass the head water jacket.

The block water jacket may include a first coolant inflow hole that is connected with the water pump and a coolant is introduced through the first coolant inflow hole.

The water chamber may include: a second coolant inflow hole that is connected with the water pump and a coolant is introduced through the second coolant inflow hole, a first coolant exhaust hole configured to discharge the introduced coolant to the EGR cooler water jacket, and a second coolant exhaust hole configured to discharge the introduced coolant to the head water jacket.

In the exemplary forms of the present disclosure, the water chamber is formed in the cylinder block, and the coolant flowing into the water chamber from the water pump is supplied to the head water jacket and the EGR cooler water jacket. Thus, it is possible to improve the durability of the EGR cooler by continuously circulating the coolant flowing to the EGR cooler and rapidly perform the engine warm-up by stopping the flow of the coolant flowing to the cylinder head and the cylinder block before the engine is warmed up.

Further, the EGR cooler water jacket and the water chamber are integrally formed with the cylinder block, and thus it is possible to provide an environment that can reduce the cooling loss by reducing the length of the cooling line and reduce cost and weight.

Further, the coolant flowing into the water chamber is cooled by a cross flow type in which the coolant moves along the longitudinal direction of the cylinder block and passes the head water jacket, and implement the separate cooling in which the coolant separately flows to the block water jacket, and thus it is possible to improve the cooling efficiency of the engine and the durability of the engine.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
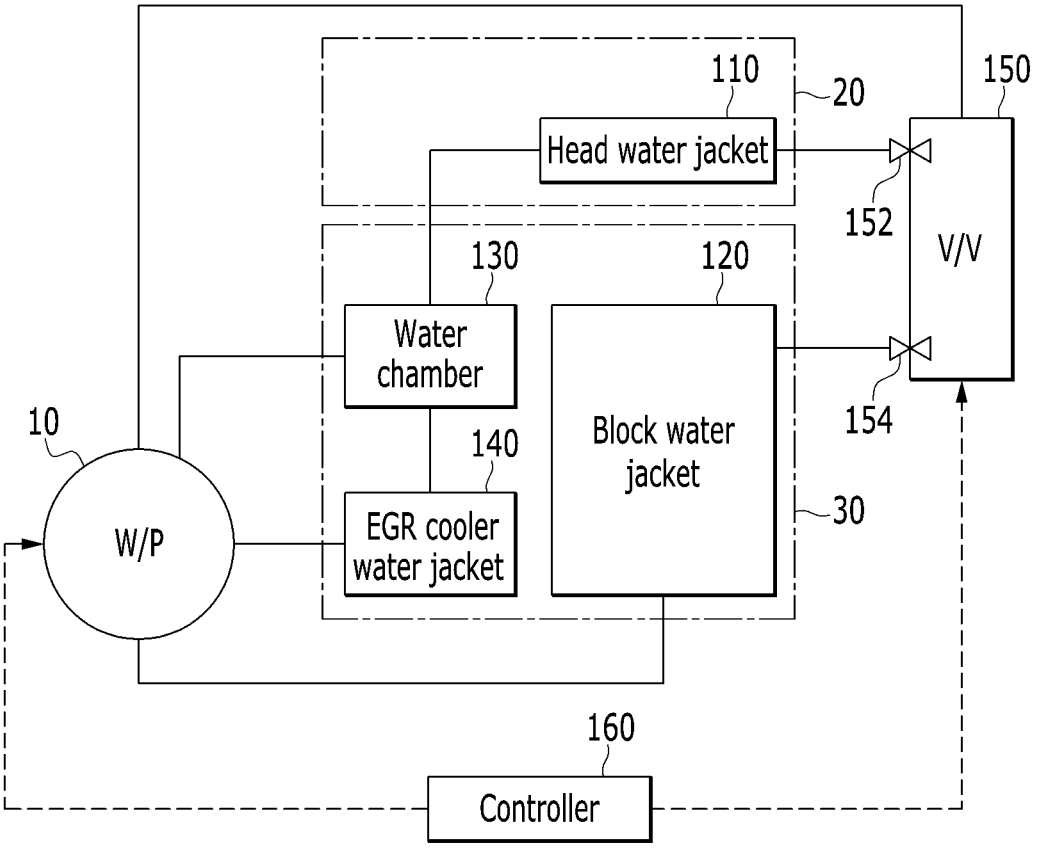
FIG. 1 is a diagram schematically illustrating an engine cooling system in one exemplary form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

In the following detailed description, only certain exemplary forms of the present disclosure have been shown and described, simply by way of illustration. As those skilled in the art would realize, the described forms may be modified in various different ways, all without departing from the spirit or scope of the present disclosure.

Throughout the present disclosure, unless explicitly described to the contrary, the word "comprise" and variations such as "comprises" or "comprising" will be understood to imply the inclusion of stated elements but not the exclusion of any other elements.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles, and other alternative fuel vehicles (e.g., fuel derived from resources other than petroleum).

An engine cooling system in one exemplary form of the present disclosure will now be described with reference to FIG. 1-2 and FIG. 4-5.

Figure 2:
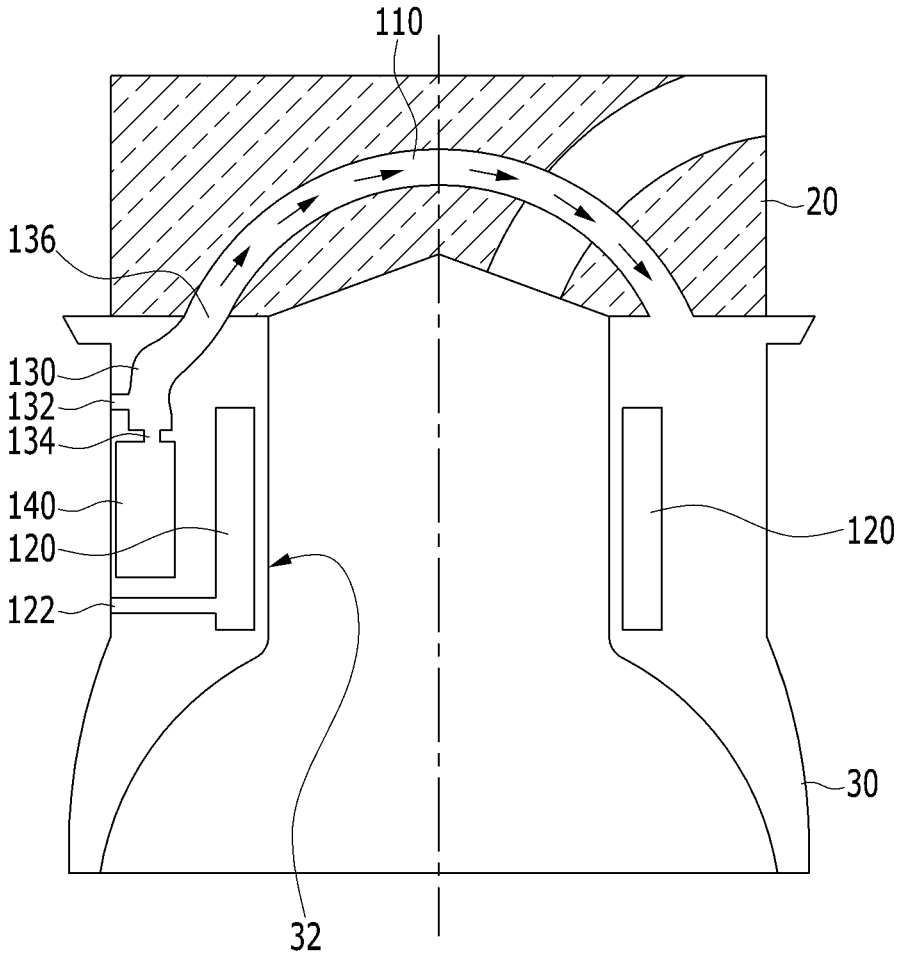
FIG. 2 is a view showing a cross-section of an engine including an engine cooling system in one exemplary form of the present disclosure.

FIG. 1 is a diagram schematically illustrating an engine cooling system, and FIG. 2 is a view showing a cross-section of an engine including an engine cooling system. In this case, the engine cooling system describes only a schematic configuration desired for description according to an exemplary form of the present disclosure, and is not limited to such a configuration.

Referring to FIG. 1 and FIG. 2, the engine cooling system is applied to the engine including a cylinder block 30 inside of which a plurality of combustion chamber 32 are provided and a piston is installed to reciprocate so as to compress or expand gas in the combustion chamber 32, and a cylinder head 20 mounted on the cylinder block 30.

The engine cooling system may include a water pump 10, a head water jacket 110, a block water jacket 120, a water chamber 130, an EGR cooler water jacket 140, a coolant control valve 150, and a controller 160.

The water pump 10 selectively pumps the coolant to the block water jacket 120 and the water chamber 130 in accordance with the driving state of an engine.

The head water jacket 110 is formed in the cylinder head 20, in particular, in an area corresponding to the combustion chamber 32.

The block water jacket 120 is formed between combustion chambers 32 in the cylinder block 30. The block water jacket 120 may be disposed along a longitudinal direction of the cylinder block 30 to be spaced apart from the combustion chamber 32 formed in the cylinder block 30 by a predetermined interval. The block water jacket 120 includes a first coolant inflow hole 122 that is connected with the water pump 10 and a coolant is introduced through first coolant inflow hole 122.

The water chamber 130 is formed in the cylinder block 30. The water chamber 130 supplies the coolant pumped from water pump 10 to the head water jacket 110 and the EGR cooler water jacket 140.

The coolant flowing into the water chamber 130 may flow along the longitudinal direction of the cylinder block 30 and pass the head water jacket 110, namely, a cross flow type.

The water chamber 130 includes: a second coolant inflow hole 132 that is connected with the water pump 10 and a coolant is introduced through the second coolant inflow hole 132; a first coolant exhaust hole 134 discharging the coolant introduced from the second coolant inflow hole 132 to the EGR cooler water jacket 140; and a second coolant exhaust hole 136 discharging the coolant introduced from the second coolant inflow hole 132 to the head water jacket 110.

The EGR cooler water jacket 140 cools EGR gas of an exhaust gas recirculation (EGR) device. The EGR cooler water jacket 140 may be formed in the cylinder block 30. That is, the water chamber 130 and the EGR cooler water jacket 140 may be integrally formed with the cylinder block 30.

The coolant flowing into the EGR cooler water jacket 140 is circulated to the water pump 10 after heat exchange with the EGR cooler (not shown).

The coolant control valve 150 adjusts flow of a coolant exhausted from the head water jacket 110 and a coolant exhausted from the block water jacket 120 according to the control by the controller 160.

The coolant control valve 150 includes a first valve 152 adjusting flow of the coolant exhausted from the head water jacket 110, and a second valve 154 adjusting flow of the coolant exhausted from the block water jacket 120.

The controller 160 controls operations of the water pump 10 and the coolant control valve 150.

The controller 160 continuously circulates the coolant flowing from the water chamber 130 to the EGR cooler water jacket 140 by controlling operation of the water pump 10.

In addition, the controller 160 controls the water pump 10 to adjust a flux of the coolant flowing into the head water jacket 110 and a flux of the coolant flowing into the block water jacket 120.

Furthermore, the controller 160 may stop the flow of the coolant exhausted from the head water jacket 110 and the coolant exhausted from the block water jacket 120 by controlling the coolant control valve 150.

For such an object, the controller 160 may be implemented with at least one processor operating by a predetermined program, and the predetermined program may be programmed to perform each step according to a method for controlling coolant of the engine cooling system in an exemplary form of the present disclosure.

Figure 3:
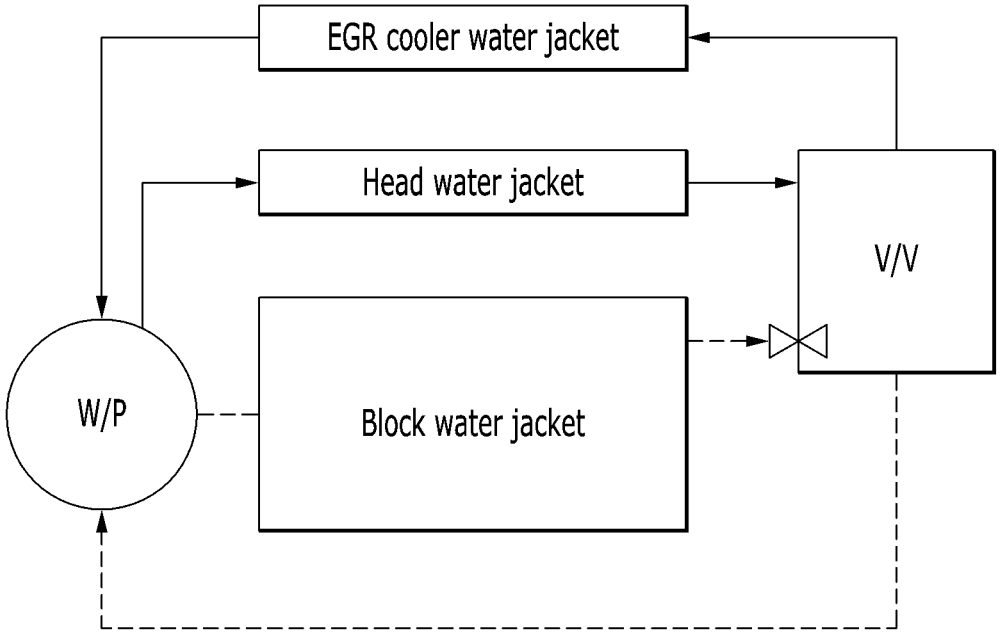
FIG. 3 is a drawing showing an engine cooling system according to the related art.

FIG. 3 is a drawing showing an engine cooling system according to the related art.

As shown in FIG. 3, in the related art, the coolant discharged from the water pump is directly flowed into the head water jacket, and the coolant exhausted from the head water jacket is continuously circulated to the water pump through the EGR cooler water jacket.

Accordingly, in the conventional engine cooling system, before the engine is warmed up, only the flow of the coolant flowing in the cylinder block is stopped, and the coolant flowing in the cylinder head is continuously circulated.

Furthermore, in the conventional engine cooling system, since the length of the cooling line is long, there is a problem in that a cooling loss is increased, and cost and weight are increased.

Figure 4:
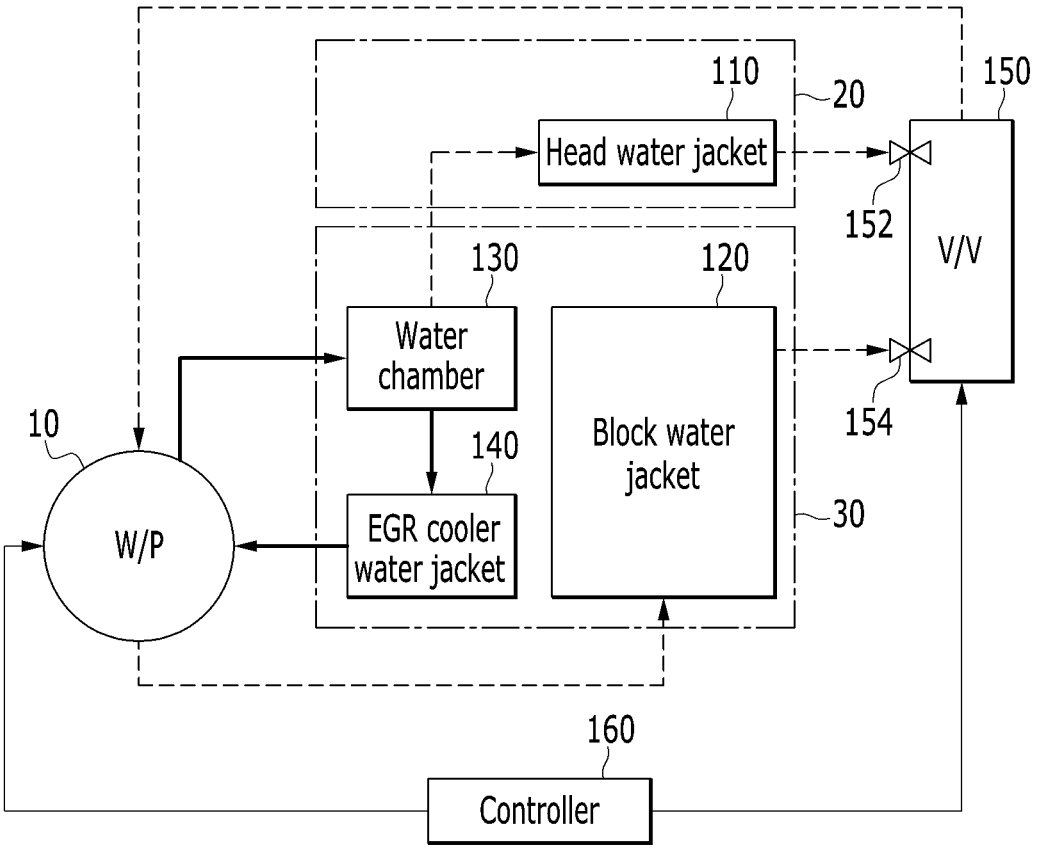
FIG. 4 is a drawing showing a flow of the coolant flowing in an EGR cooler and an engine before the engine is warmed up in one exemplary form of the present disclosure.

FIG. 4 is a drawing showing a flow of the coolant flowing in an EGR cooler and an engine before the engine is warmed up in one exemplary form of the present disclosure.

Referring to FIG. 4, before the engine is warmed up, the coolant control valve 150 may be closed, and the flow of the coolant exhausted from the head water jacket 110 and the flow of the coolant exhausted from the block water jacket 120 may be stopped.

At that time, the coolant flowing into the EGR cooler water jacket 140 is continuously circulated to the water pump 10 regardless of operation of the coolant control valve 150.

That is, the engine cooling system continuously circulates the coolant flowing to the EGR cooler water jacket 140 before the engine is warmed up, and stops the flow of the coolant flowing to the engine.

Figure 5:
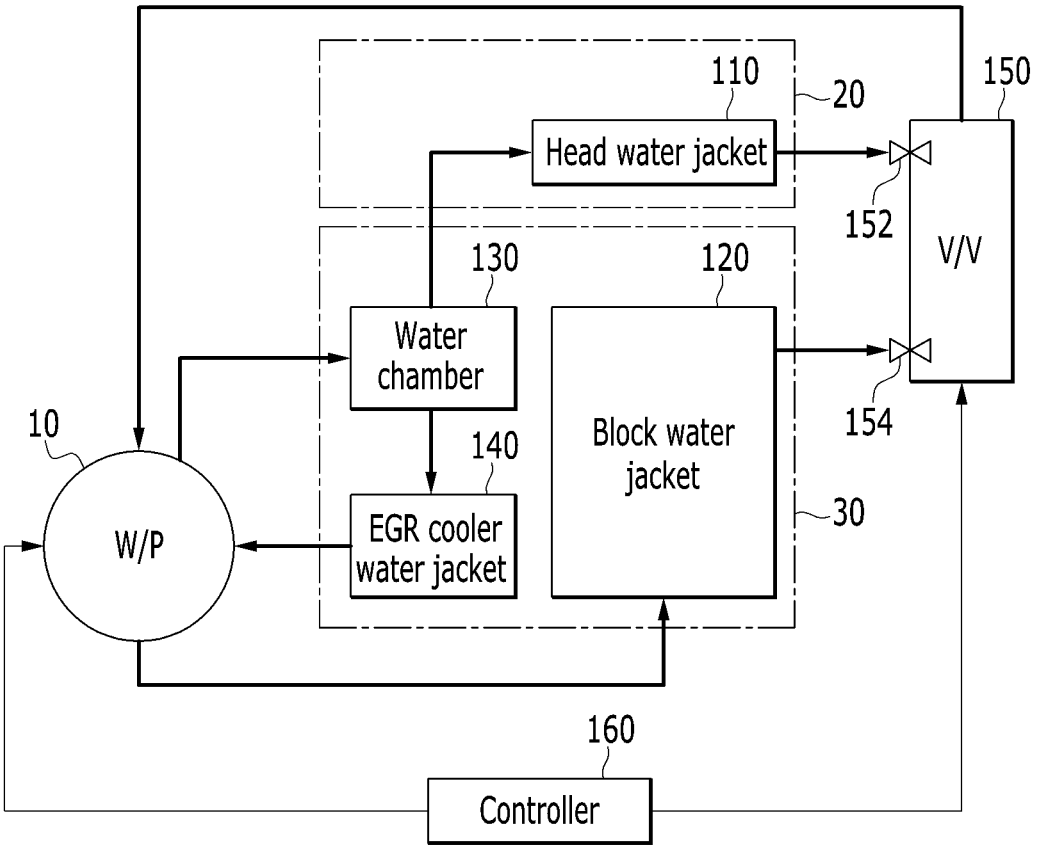
FIG. 5 is a drawing showing a flow of the coolant flowing in an EGR cooler and an engine after the engine is warmed up in one exemplary form of the present disclosure.

FIG. 5 is a drawing showing a flow of the coolant flowing in an EGR cooler and an engine after the engine is warmed up in one exemplary form of the present disclosure.

Referring to FIG. 5, after the engine is warmed up, the coolant control valve 150 is opened, and the coolant flowing into the head water jacket 110 and the coolant flowing into the block water jacket 120 are exhausted. At that time, the coolant exhausted from the head water jacket 110 and the coolant exhausted from the block water jacket 120 are circulated to the water pump 10.

That is, after the engine is warmed up, the coolant moves from the water chamber 130 to the EGR cooler water jacket 140, and the coolant flowing into the head water jacket 110 from the water chamber 130 and the coolant flowing into the block water jacket 120 from the water pump 10 are circulated to the water pump 10.

As described, the engine cooling system in an exemplary form of the present disclosure forms the water chamber in the cylinder block, and supplies the coolant flowing into the water chamber from the water pump to the head water jacket and the EGR cooler water jacket. Therefore, it is possible to improve the durability of the EGR cooler by continuously circulating the coolant flowing to the EGR cooler and rapidly perform the engine warm-up by stopping the flow of the coolant flowing to the cylinder head and the cylinder block before the engine is warmed up.

Further, in the engine cooling system in exemplary forms of the present disclosure, the EGR cooler water jacket and the water chamber are integrally formed with the cylinder block, and thus it is possible to provide an environment that can reduce the cooling loss by reducing the length of the cooling line and reduce cost and weight.

Further, in the engine cooling system of the present disclosure, the coolant flowing into the water chamber is cooled by a cross flow type which the coolant moves along the longitudinal direction of the cylinder block and passes the head water jacket, and implement the separate cooling in which the coolant separately flows to the block water jacket, and thus it is possible to improve the cooling efficiency of the engine and the durability of the engine.

While this present disclosure has been described in connection with what is presently considered to be practical exemplary forms, it is to be understood that the present disclosure is not limited to the disclosed forms, but, on the contrary, is intended to cover various modifications and equivalent arrangements included within the spirit and scope of the present disclosure.

What is claimed is:

1. An engine cooling system, comprising:

a head water jacket that is formed within a cylinder head;

a block water jacket that is formed within a cylinder block;

an exhaust gas recirculation (EGR) cooler water jacket configured to cool EGR gas of an exhaust gas recirculation (EGR) device;

a water chamber formed independently from the block water jacket within the cylinder block, the water chamber not fluidically connected to the block water jacket within the cylinder block, the water chamber configured to supply a coolant to the head water jacket and the EGR cooler water jacket; and a water pump configured to pump the coolant to the block water jacket and the water chamber based on a driving state of an engine.

2. The system of claim 1, wherein the EGR cooler water jacket and the water chamber are integrally formed with the cylinder block.

3. The system of claim 1, further comprising:

a coolant control valve configured to adjust a flow of a coolant exhausted from the head water jacket and a coolant exhausted from the block water jacket.

4. The system of claim 3, further comprising:

a controller configured to control operations of the water pump and the coolant control valve, wherein the controller is configured to continuously circulate the coolant flowing from the water chamber to the EGR cooler water jacket by controlling operation of the water pump.

5. The system of claim 4, wherein before the engine is warmed up, the controller is configured to close the coolant control valve and stop the flow of the coolant exhausted from the head water jacket and the coolant exhausted from the block water jacket.

6. The system of claim 4, wherein the controller is configured to open the coolant control valve after the engine is warmed up, and allow the flow of the coolant exhausted from the head water jacket and the coolant exhausted from the block water jacket.

7. The system of claim 1, wherein the coolant flowing into the water chamber flows along a longitudinal direction of the cylinder block and passes the head water jacket.

8. The system of claim 1, wherein the block water jacket includes a first coolant inflow hole that is connected with the water pump and a coolant is introduced through the first coolant inflow hole.

9. The system of claim 8, wherein the water chamber includes:

a second coolant inflow hole that is connected with the water pump and a coolant is introduced through the second coolant inflow hole, a first coolant exhaust hole configured to discharge the introduced coolant to the EGR cooler water jacket, and a second coolant exhaust hole configured to discharge the introduced coolant to the head water jacket.

10. An engine cooling system, comprising:

a head water jacket that is formed within a cylinder head;

a block water jacket that is formed within a cylinder block;

an exhaust gas recirculation (EGR) cooler water jacket configured to cool EGR gas of an exhaust gas recirculation (EGR) device;

a water chamber formed independently from the block water jacket within the cylinder block, and configured to supply a coolant to the head water jacket and the EGR cooler water jacket; and a water pump configured to pump the coolant separately to the block water jacket via a first line and the water chamber via a second line, based on a driving state of an engine.

11. The system of claim 10, wherein the EGR cooler water jacket and the water chamber are integrally formed with the cylinder block.

12. The system of claim 10, further comprising:

a coolant control valve configured to adjust a flow of a coolant exhausted from the head water jacket and a coolant exhausted from the block water jacket.

13. The system of claim 12, wherein the coolant control valve includes:

a first valve adjusting flow of coolant exhausted from the head water jacket, and a second valve adjusting flow of the coolant exhausted from the block water jacket.

14. The system of claim 12, further comprising:

a controller configured to control operations of the water pump and the coolant control valve, wherein the controller is configured to continuously circulate the coolant flowing from the water chamber to the EGR cooler water jacket by controlling operation of the water pump.

15. The system of claim 14, wherein before the engine is warmed up, the controller is configured to close the coolant control valve and stop the flow of the coolant exhausted from the head water jacket and the coolant exhausted from the block water jacket.

16. The system of claim 14, wherein the controller is configured to open the coolant control valve after the engine is warmed up, and allow the flow of the coolant exhausted from the head water jacket and the coolant exhausted from the block water jacket.

17. The system of claim 10, wherein the coolant flowing into the water chamber flows along a longitudinal direction of the cylinder block and passes the head water jacket.

18. The system of claim 10, wherein the block water jacket includes a first coolant inflow hole that is connected with the water pump and a coolant is introduced through the first coolant inflow hole.

19. The system of claim 18, wherein the water chamber includes:

a second coolant inflow hole that is connected with the water pump and a coolant is introduced through the second coolant inflow hole, a first coolant exhaust hole configured to discharge the introduced coolant to the EGR cooler water jacket, and a second coolant exhaust hole configured to discharge the introduced coolant to the head water jacket.

* * * * *